US006210230B1

(12) United States Patent
Lai

(10) Patent No.: US 6,210,230 B1
(45) Date of Patent: Apr. 3, 2001

(54) CABLE CONNECTOR

(75) Inventor: Chin-Te Lai, Tao-Yuan (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/448,096

(22) Filed: Nov. 23, 1999

(30) Foreign Application Priority Data

Aug. 24, 1999 (TW) ..... 88214392

(51) Int. Cl.[7] ..... H01R 13/652
(52) U.S. Cl. ..... 439/610; 439/101; 439/579
(58) Field of Search ..... 439/607–610, 439/101, 108, 98, 99, 579

(56) References Cited

U.S. PATENT DOCUMENTS 5,711,686 * 1/1998 O'Sullivan et al. ..... 439/610
5,716,236 * 2/1998 O'Sullivan et al. ..... 439/610
5,718,607 * 2/1998 Murphy et al. ..... 439/610
5,768,771 * 6/1998 O'Sullivan ..... 28/829
5,961,348 * 10/1999 Murphy ..... 439/610

* cited by examiner

*Primary Examiner*—Gary F. Paumen
(74) *Attorney, Agent, or Firm*—Wei Te Chung

(57) ABSTRACT

A cable connector subassembly mainly comprises an insulative housing, a number of data terminals and a terminating system for high speed cables including a number of signal terminals, a dielectric spacer and a conductive grounding plate. The grounding plate is of a two-layer configuration and has an upper and a lower plate connected at a forward end, a rear end of the grounding plate having arms adapted to hold cables and be in contact with metallic shields of the cables. The grounding plate is firmly held in the spacer, which in turn engages with the insulative housing. The spacer has passageways for the signal terminals extending through. The signal terminals have latch structures at approximately a middle section thereof for interferentially engaging with the spacer and the housing, respectively. A forward shroud fits over a front end of the housing, and the connector subassembly and the forward shroud are enclosed by a pair of shielding shells and a pair of covers.

1 Claim, 9 Drawing Sheets

CABLE CONNECTOR

BACKGROUND OF THE INVENTION

1. Field of the Invention

The present invention relates to an electrical connector and particularly to a hybrid connector terminated to a transmission line.

2. Description of the Prior Art

With the ever-increasing miniaturization of electronic devices in a variety of industries, such as in the computer and telecommunication industries, along with the accompanying miniaturization of electrical connectors, considerable problems have been encountered in terminating miniature high-speed cables. A terminating system is normally disposed in a cable connector for terminating high-speed or high frequency coaxial cables of a transmission line. Examples of related art are disclosed in U.S. Pat. Nos. 5,711,686; 5,716,236; 5,718,607; and 5,768,771. As is shown in FIGS. 8 and 9, a fragment of a conventional cable connector 9 includes a dielectric housing 90, a forward shroud 91, two screws 92, a cover 93, and a terminating system 14. The terminating system 14 includes a grounding plate 94 and a pair of contact blocks 95 in which four contacts 96 are insert molded. One end of the grounding plate 94 has four arms 941 forming channels therein to hold high-speed cables 10 and to be in contact with metallic shields 11 of the cables 10. The other end of the grounding plate 94 electrically connects with a corresponding element of a complementary electrical connector (not shown) to form a grounding path. The grounding plate 94 is partially accommodated in the dielectric housing 90 by being sandwiched between the contact blocks 95, one upper, one lower. The contacts 96 are arranged in pairs on both sides of the grounding plate 94 to terminate inner conductors of the cables 10 held in the arms 941. The contacts 96 must be precisely positioned in the course of insert molding. The small contacts 96 have a fragile structure and may be damaged or distorted by high-pressure molten plastic during the insert molding process. The two contact blocks 95 are first separately molded and are then assembled together to retain the grounding plate 94 therebetween. Such an assembly process is complicated and time and cost inefficient. Therefore, a cable connector with a terminating system, which can solve the above-mentioned problems, is desired.

SUMMARY OF THE INVENTION

A main object of the present invention is to provide a cable connector having an improved terminating system for reliably terminating high-speed cables and resolving problems of the conventional art.

A cable connector in accordance with the present invention mainly comprises a pair of covers, a pair of shielding shells, a forward shroud, an insulative housing, a plurality of data terminals arranged in terminal modules, and a terminating system for terminating high-speed cables.

The terminating system includes a dielectric spacer for being accommodated in the housing, a grounding plate stably retained in the spacer, and two pairs of signal terminals for connecting to inner conductors of the high-speed cables. The spacer defines corresponding passageways for the signal terminals to extend through. The grounding plate is of a two-layer configuration and has an upper and a lower plate connected at a leading edge. The grounding plate has an end opposite to the leading edge formed with four arms to hold the high-speed cables therein and to connect with metallic shields of the cables. The signal terminals each comprise a latch structure at an intermediate portion thereof including a first widened portion and a second widened portion. The first widened portion of the latch structure is dimensioned to be accommodated in a corresponding passage of the spacer and the second widened portion, having a larger width, fits between the housing and the spacer, thereby reliably retaining the signal terminals.

The housing defines a plurality of through holes therethrough, a slit adjacent to the through holes, and a pair of apertures disposed at each of opposite sides of the slit. The data terminals extend through the through holes and front ends of the grounding plate and the signal terminals extend through the slit and the apertures, respectively, into the forward shroud assembled to the housing.

Other objects, advantages and novel features of the invention will become more apparent from the following detailed description when taken in conjunction with the accompanying drawings.

DETAILED DESCRIPTION OF THE INVENTION

Figure 1:
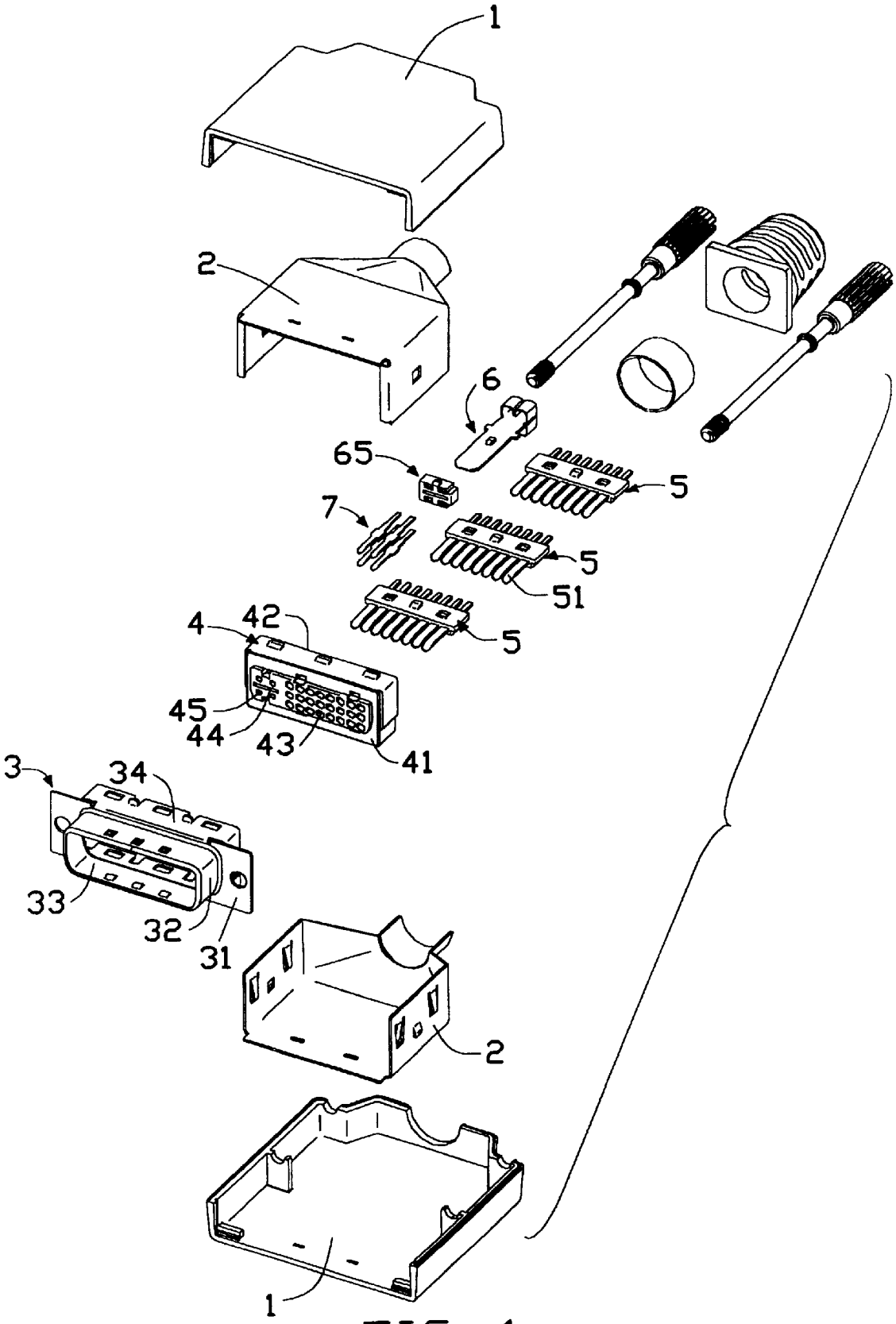
FIG. 1 is an exploded perspective view of a cable connector of the present invention.
Figure 2:
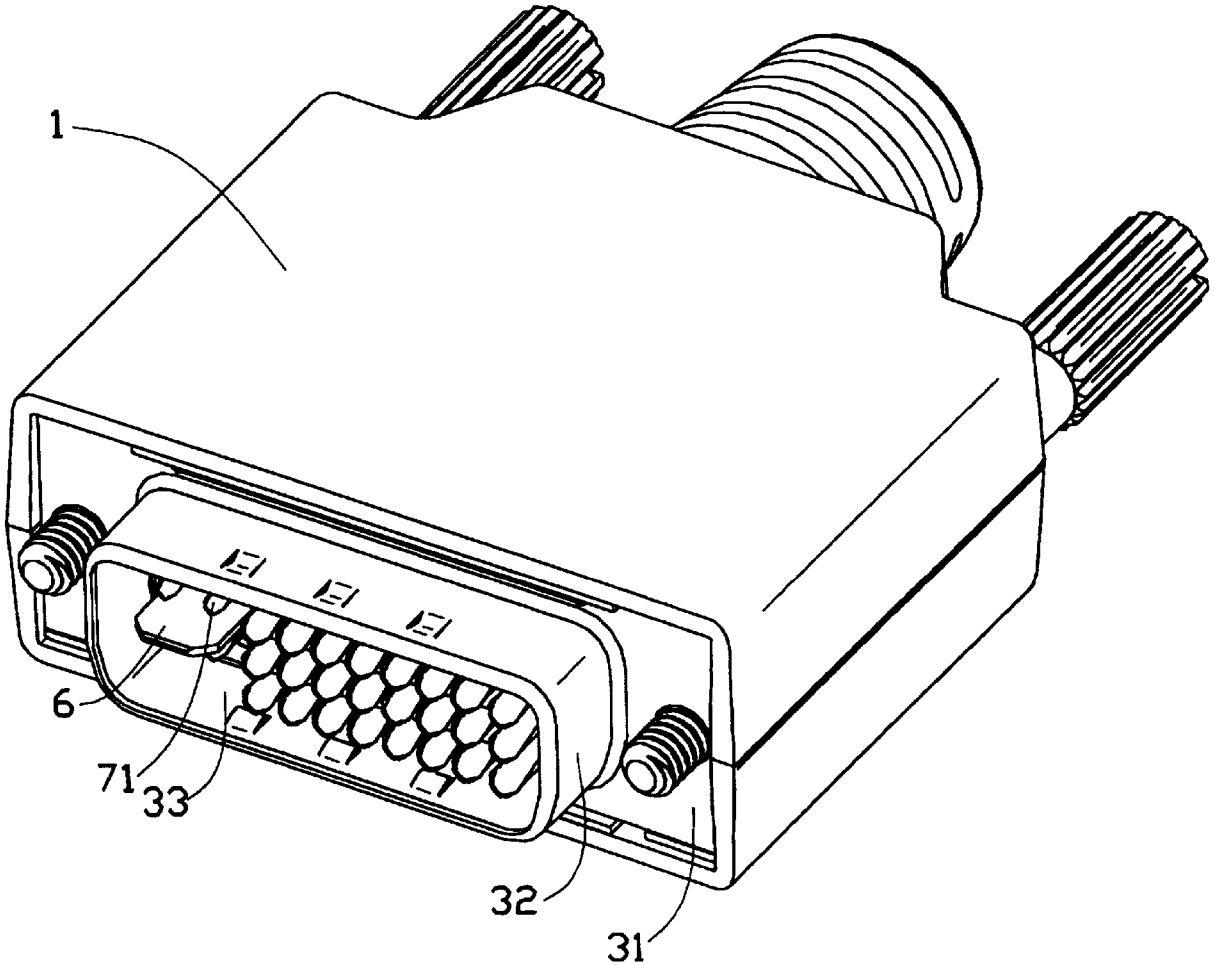
FIG. 2 is an assembled view of FIG. 1.
Figure 3:
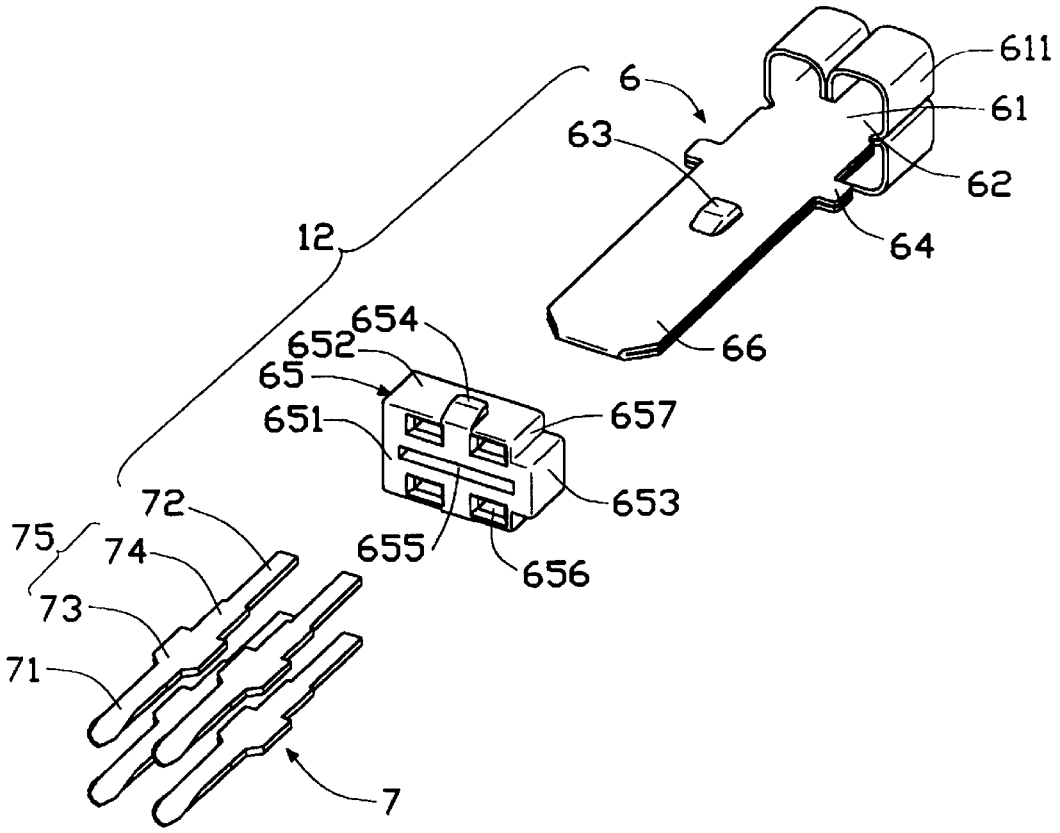
FIG. 3 is an exploded perspective view a terminating system of the present invention including a grounding plate, a spacer and four signal terminals.

Referring to FIGS. 1–3, a cable connector according to a preferred embodiment of the present invention mainly comprises a pair of covers 1, a pair of shielding shells 2, a forward shroud 3 and a cable connector subassembly. The cable connector subassembly comprises an insulative housing 4, three terminal modules 5, and a terminating system 12. The terminating system 12 includes a conductive grounding plate 6, a dielectric spacer 65, and four signal terminals 7. Each terminal module 5 includes an elongated block and a plurality of data terminals 51.

The insulative housing 4 is rectangular and has a mating face 41 and a connecting face 42 opposite to the mating face 41. A cavity (not shown) is defined in the connecting face 42 to accommodate the terminal modules 5 and the spacer 65. The housing 4 defines a plurality of through holes 43 therethrough in communication with the cavity in the connecting face 42, a horizontal slit 44 and a pair of apertures 45 therethrough at each side of the slit 44 adjacent to the through holes 43.

The forward shroud 3 has a base 31, a front shell 32 depending from a front face of the base 31 in a forward direction, and a rear shell 34 depending from a rear face of the base 31 in a rearward direction. The front shell 32 defines an engaging cavity 33 therein to engage with a complementary connector and the rear shell 34 defines an opening (not shown) therewithin to receive the housing 4.

The grounding plate 6 is of a two-layer configuration and has an upper and a lower plate connected at a leading edge by a bend. The grounding plate 6 has a blade portion 66 at a front end thereof and a connection portion 61 at an opposite rear end thereof. Four three-sided arms 611, one opposite another, are formed by metal strips extending upwards from opposite lateral edges of the rear end of the grounding plate 6 and bending horizontally before then bending vertically downwards. Corresponding holding spaces 62 are defined within the arms 611. Each of the upper and lower plate of the grounding plate 6 forms a stamped projection 63 near a middle section thereof. A pair of teeth 64 symmetrically extends outwards from each lateral edge between the projections 63 and the arms 611 of the grounding plate 6.

The dielectric spacer 65 is roughly a cube mountable to the grounding plate 6. The spacer 65 defines a slot 655 therethrough from a front surface 651 to a rear surface (not shown) opposite to the front surface 651 thereof and a pair of passages 656 at each side of the slot 655. A top surface 652 and a bottom surface (not shown) opposite to the top surface 652 of the spacer 65 each forms a tab 654 to engage with the housing 4. A right side surface 657 of the spacer 65 has a protrusion 653 protruding outwards therefrom and having an anti-polarizing function in assembly.

Each signal terminal 7 comprises a front portion 71 at a front end, a rear portion 72 at a rear end, and a latch structure 75 therebetween. The latch structure 75 includes a first widened portion 74 adjacent to the rear portion 72 and a second widened portion 73 between the first widened portion 74 and the front portion 71. The width of the first widened portion 74 is larger than those of the front and rear portions 71, 72, and smaller than that of the second widened portion 73, but is substantially equal to the width of the passages 656 of the spacer 65.

Figure 4:
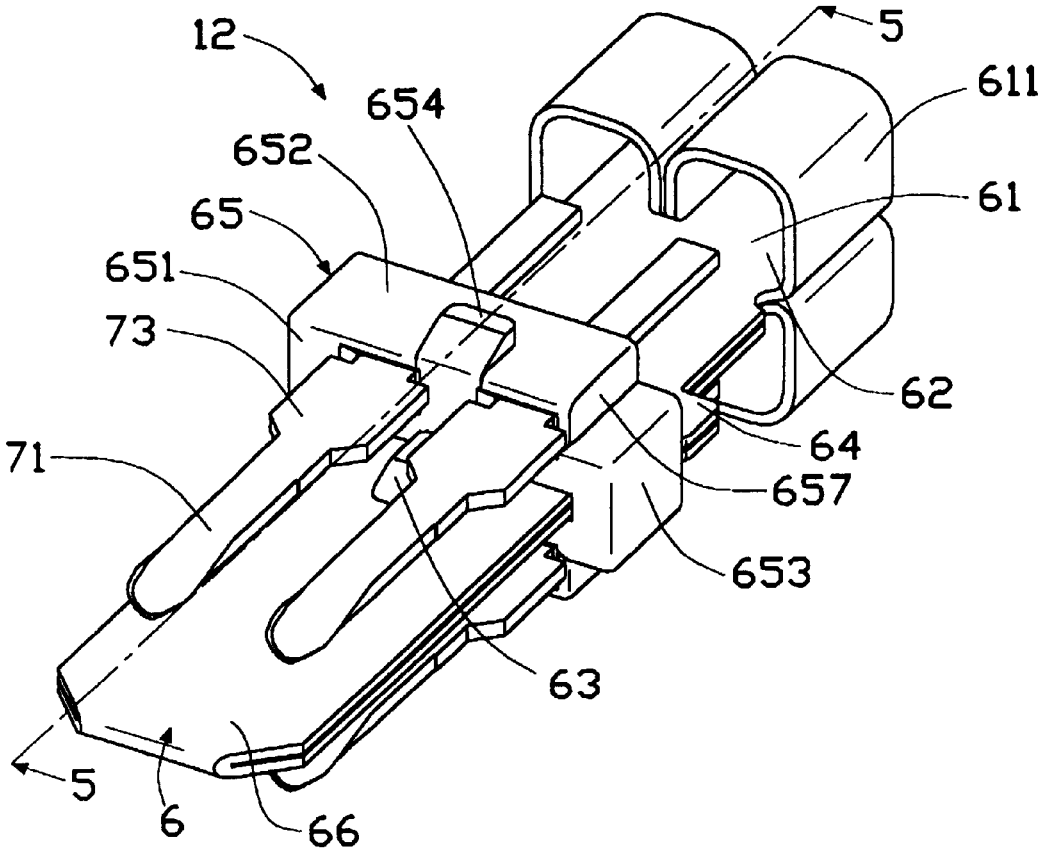
FIG. 4 is an assembled view of FIG. 3.
Figure 5:
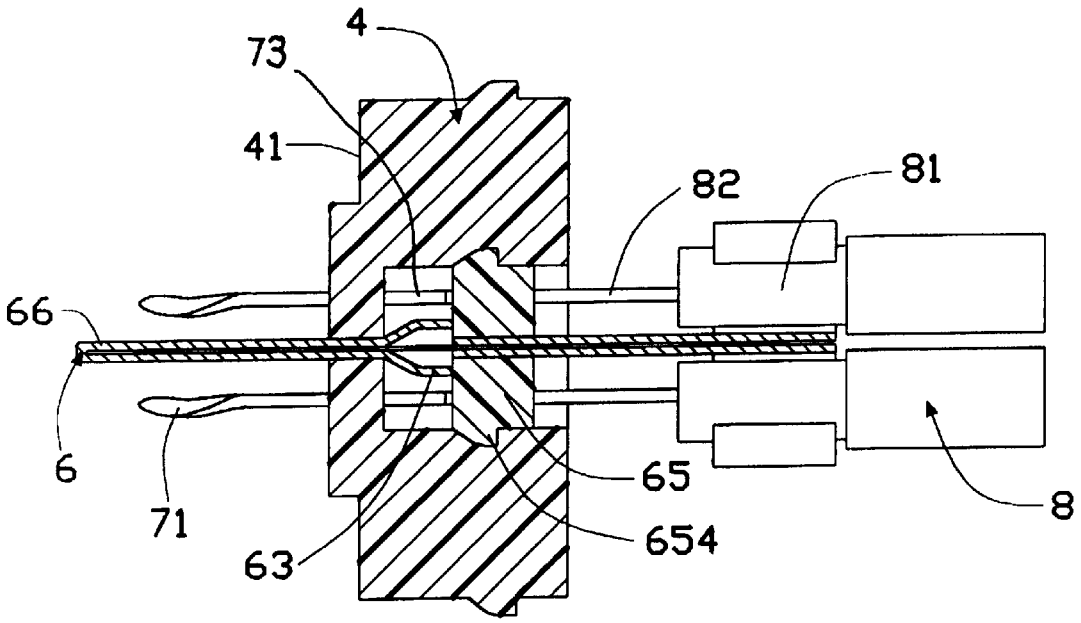
FIG. 5 is a cross-sectional view taken from line 5—5 of FIG. 4.

Referring to FIGS. 2, 4 and 5, in assembly the grounding plate 6 is inserted through the slot 655 of the spacer 65 until the spacer 65 is stopped between the projections 63 and the teeth 64 of the grounding plate 6. The first widened portions 74 of the signal terminals 7 are fitted in the passages 656 of the spacer 65 while the second widened portions 73 of the signal terminals 7 are stopped by the front surface 651 of the spacer 65. The terminal modules 5 are inserted through the through holes 43 thereby being retained by the housing 4. The assembled terminating system 12 is assembled with the housing 4 with the tabs 654 and the protrusion 653 engaging with corresponding structures (not shown) in the connecting face 42 of the housing 4. The passages 656 and the slot 655 of the spacer 65 are aligned with the apertures 45 and the slit 44 of the housing 4, so that the front portions 71 of the signal terminals 7 and the blade portion 66 of the grounding plate 6 extend through the apertures 45 and the slit 44, respectively. The second widened portions 73 of the signal terminals 7 is pressed by corresponding structures in the housing 4 to provide a further retention to the signal terminals 7. While the housing 4 with the terminating system 12 and the terminal modules 5 is assembled with the forward shroud 3, the blade portion 66, the front portions 71 and front ends of the data terminals 51 are accommodated in the engaging cavity 33 to be shielded. In use, the rear portions 72 of the signal terminals 7 are connected with inner conductors 82 of cables 8 and the arms 611 of the grounding plate 6 are in contact with metallic shields 81 of the cables 8 for the purposes of transmitting electrical signals and grounding the cable shields 81, respectively. The blade portion 66 contacts a corresponding element of a complementary connector to form a grounding path and provide effective shielding.

The signal terminals 7 are not insert molded in the spacer 65 and need not be positioned during manufacturing of the spacer, thereby overcoming the difficulties in alignment of the conventional art and facilitating connection of the terminals 7 with the conductors 82 of the cables 8. The signal terminals 7 are retained by the latch structures 75 engaging respectively with the insulative housing 4 and the spacer 65, thereby providing a reliable retention during pull or insertion of the cable connector. One spacer 65 retains the grounding plate 6 thus simplifying the manufacturing procedure.

Figure 6:
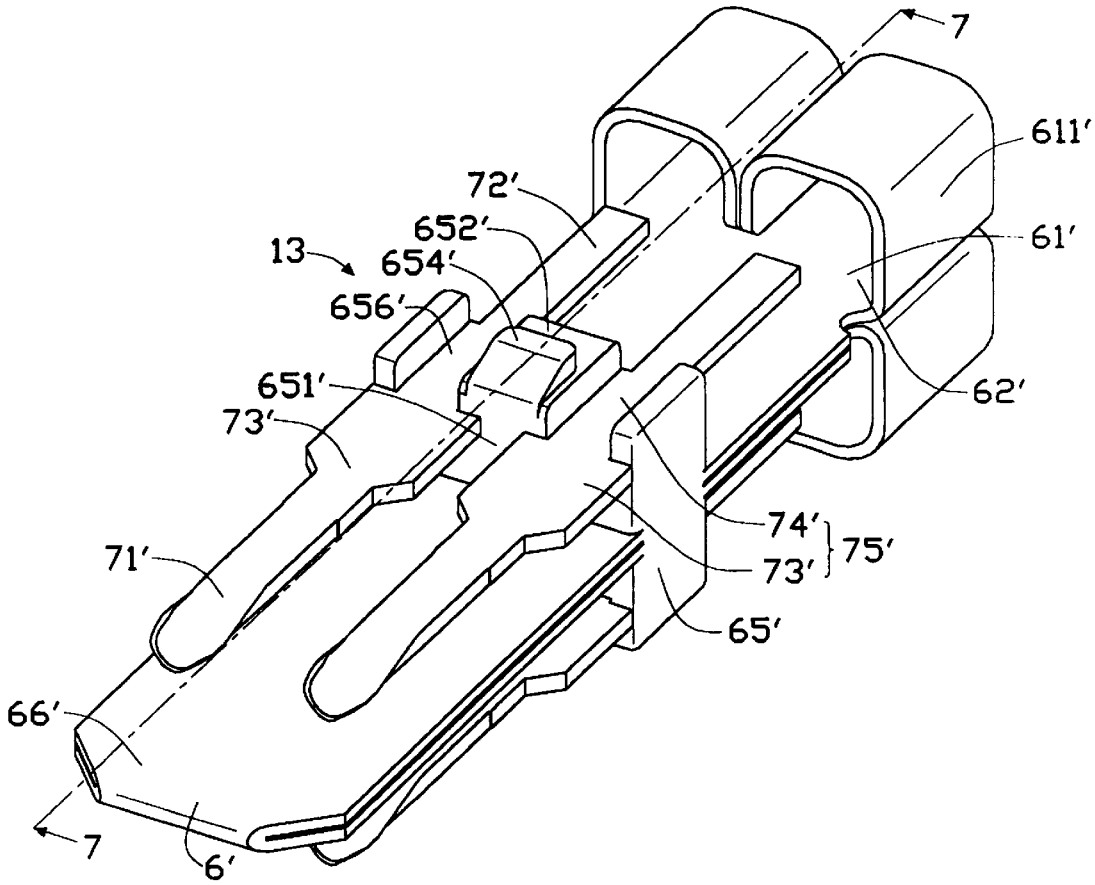
FIG. 6 is a perspective view of a terminating system of an alternative embodiment of the present invention including a grounding plate insert molded in a spacer and four signal terminals.

Referring to FIG. 6, a terminating system 13 of an alternative embodiment of the present invention comprises a conductive grounding plate 6' insert molded in a dielectric spacer 65' and four signal terminals 7'. The grounding plate 6' includes a blade portion 66' at a leading edge thereof and a connection portion 61' at an opposite end thereof. The grounding plate 6' is of a two-layer configuration and has an upper and a lower plate connected at a forward end by a bend. Four three-sided arms 611' one opposite another are formed by metal strips extending upwards from lateral edges of the rear end of the grounding plate 6' and bending horizontally before then bending vertically downwards. The spacer 65' is located at an approximately longitudinal middle section of the grounding plate 6'. The spacer 65' defines a pair of U-shaped channels 656' separated by a block 652' at each side of the grounding plate 6' and a tab 654' at the top surface of each block 652'. Each of the signal terminals 7' includes a front portion 71' at a front end thereof, a rear portion 72' at an opposite end thereof, and a latch structure 75' therebetween. The latch structure 75' comprises a second widened portion 73' adjacent to the front portion 71', and a first widened portion 74' between the second widened portion 73' and the rear portion 72'. The first widened portion 74' has a width larger than the front portion 71' and the rear portion 72' and smaller than the second widened portion 73', but is substantially equal to the width of the channel 656'.

Figure 7:
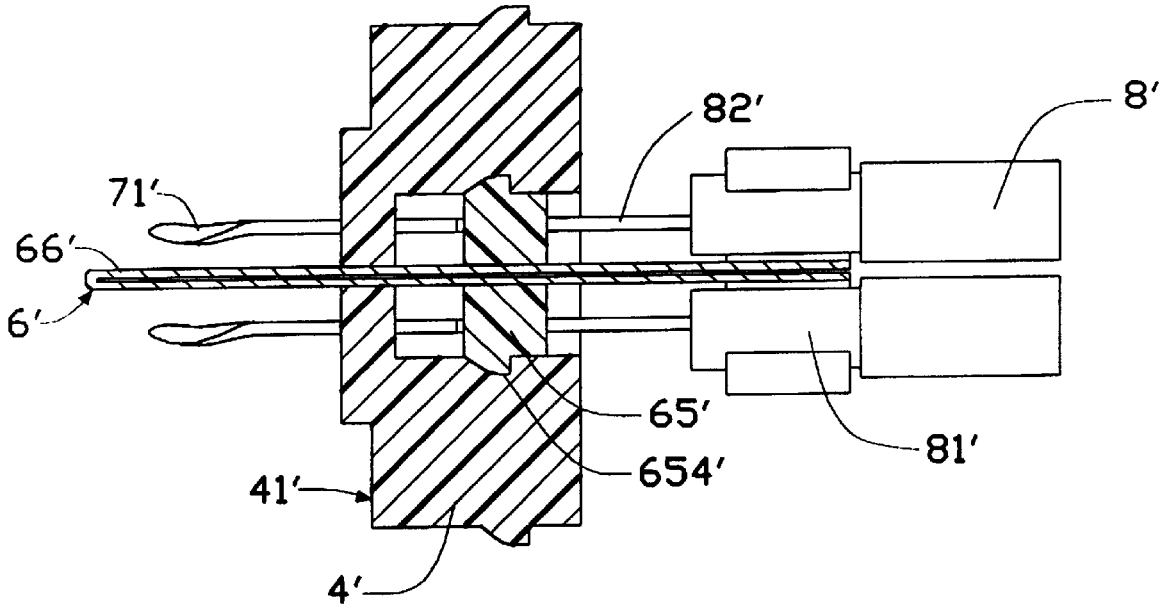
FIG. 7 is a cross-sectional view taken from line 7—7 of FIG. 6, plus a housing surrounding the terminating system.
Figure 8:
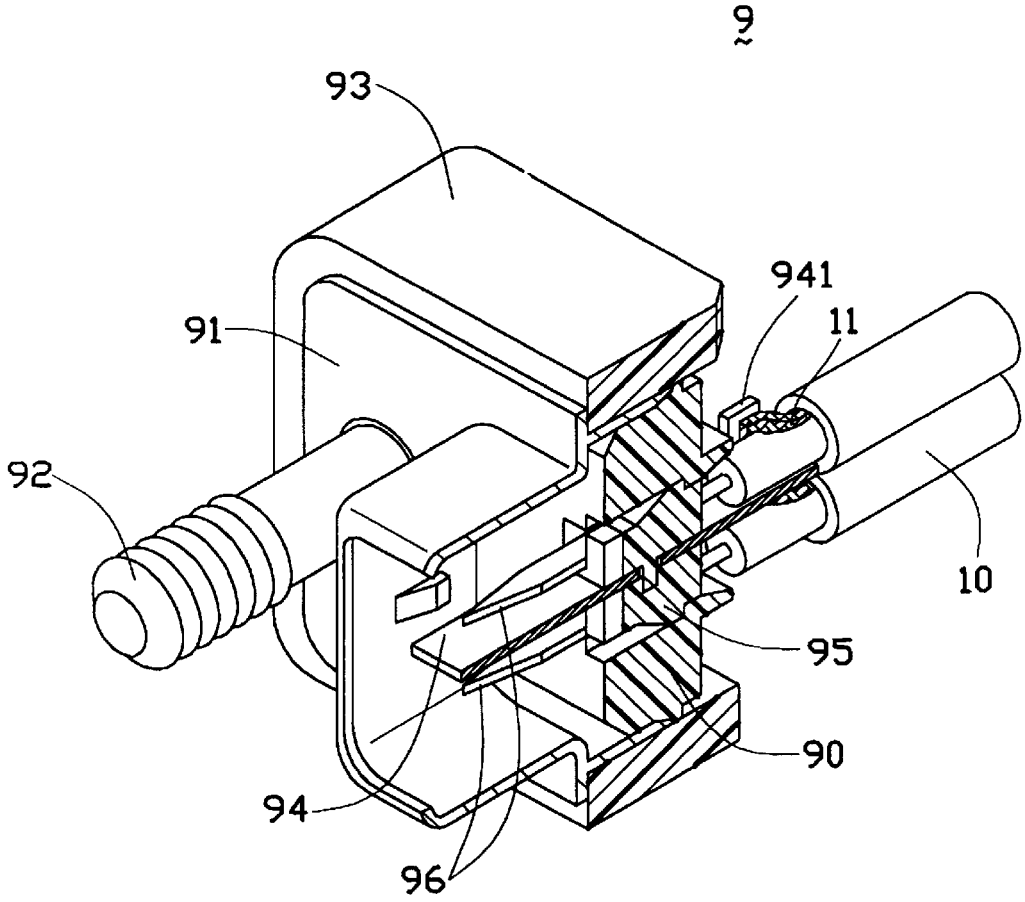
FIG. 8 (PRIOR ART)
FIG. 8 is a fragment vertical cross-sectional view of a conventional cable connector.
Figure 9:
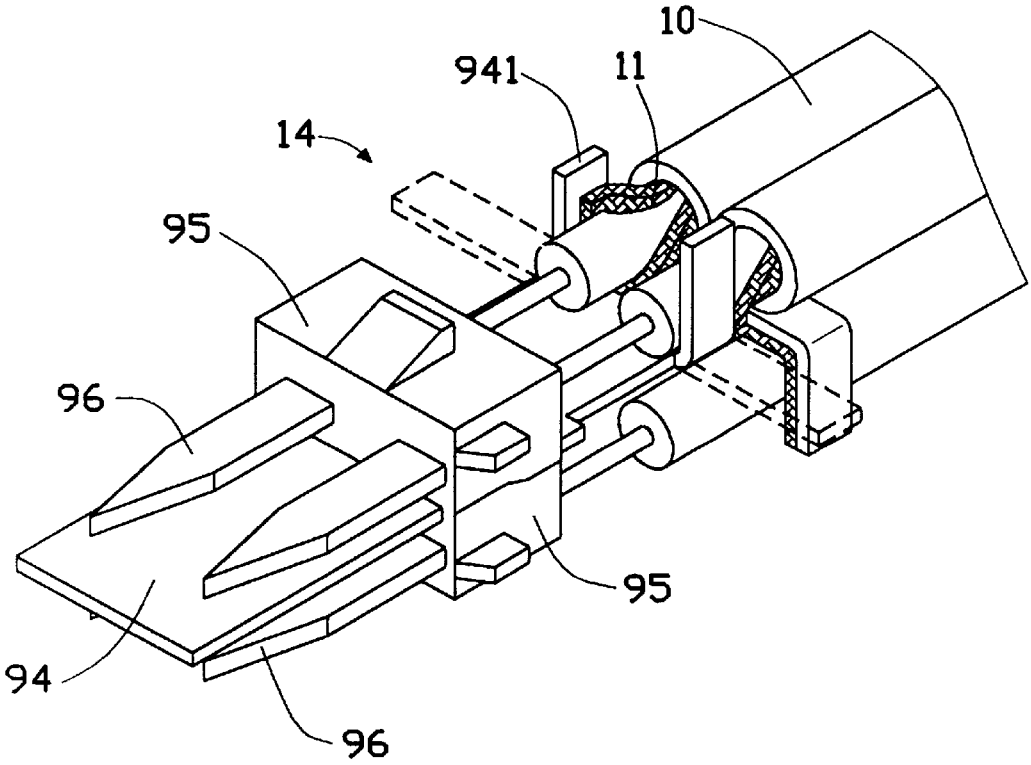
FIG. 9 (PRIOR ART)
FIG. 9 is a perspective assembled view of a terminating system of the cable connector in FIG. 8 including a grounding plate, two contact blocks with four signal contacts.

Referring to FIG. 7, in assembly, the first widened portions 74' of the signal terminals 7' are interferentially fitted into the corresponding channels 656' of the spacer 65', and the second widened portions 73' are stopped by the front surface 651' of the spacer 65'. The assembled terminating system 13 is then assembled with the insulative housing 4', the tabs 654' and the front sides of the second widened portion 73' being engaged with corresponding structures in the housing 4' respectively to reliably retain the grounding plate 6' and the signal terminals 7'. In use, the rear portions 72' connect to inner conductors 82' of cables 8' held in the holding spaces 62' while the arms 611' contact with metallic shields 81' of the cables 8' in the holding spaces 62' of the arms 611'.

The signal terminals 7' are also not insert molded in the spacer 65' and thus need not be positioned during manufacturing of the spacer, thereby overcoming the difficulties in alignment of the conventional art and facilitating connection of the terminals 7' with the conductors 82' of the cables 8'. The signal terminals 7' are retained by the latch structures 75' respectively engaging with the insulative housing 4' and the spacer 65', thereby providing a reliable retention during pull or insertion of the cable connector. The grounding plate 6' is insert molded in one spacer 65' thereby avoiding assembly and simplifying manufacturing.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector subassembly, comprising:

an insulative housing defining a cavity at a rear side thereof, a plurality of through holes therethrough in communication with the cavity, a slit adjacent to the through holes, and a pair of apertures at either side of the slit;

a plurality of data terminals being disposed in the plurality of through holes of the insulative housing; and a terminating system for terminating high-speed cables, including:

a dielectric spacer being accommodated in the cavity of the insulative housing and defining a plurality of passageways therethrough, the passageways being aligned with the apertures of the housing;

a plurality of signal terminals terminated to inner conductors of a cable and each having a latch structure at approximately an intermediate portion thereof, the latch structure being partially fitted into a corresponding passageway of the spacer and engaged with the insulative housing, a front end of each signal terminal extending through a corresponding aperture of the insulative housing; and a conductive grounding plate being retained in the housing by the spacer, the grounding plate having one end formed with four arms adapted to be in contact with metallic shields of cables terminated to the plurality of signal terminals and having another end extending through the slit of the housing;

wherein the latch structure of each signal terminal comprises a first widened portion adjacent to one end of the terminal and a second widened portion between the first widened portion and an opposite end of the terminal;

wherein each passageway of the spacer is dimensioned to accommodate the first widened portion of the signal terminal;

wherein the second widened portion of each signal terminal mates with the insulative housing at a front side thereof and is stopped by a front surface of the spacer at a rear side thereof, wherein the grounding plate is an elongated plate of a two-layer configuration and has upper and lower plates connected at a forward end thereof;

wherein each layer of the grounding plate forms a projection at approximately a middle section of the outer side thereof and a pair of teeth extending outwardly from two opposite lateral edges thereof between the projection and the arms;

wherein the spacer defines a slot aligned with the slit of the housing for the grounding plate to extend through, thereby retaining the spacer between the projections and the teeth of the grounding plate;

wherein the grounding plate is insert molded in the spacer.

* * * * *